United States Patent [19]

Burgeson

[11] 4,022,317

[45] May 10, 1977

[54] PACKAGE FOR FRAGILE OBJECTS

[75] Inventor: Duane A. Burgeson, Ann Arbor, Mich.

[73] Assignee: KMS Fusion, Inc., Ann Arbor, Mich.

[22] Filed: July 7, 1975

[21] Appl. No.: 593,705

[52] U.S. Cl. ..... 206/205; 174/17.05; 206/521; 206/523; 206/525; 250/506

[51] Int. Cl.[2] ..... B65D 81/02; B65D 85/30

[58] Field of Search ..... 174/17.05; 206/.6, 45.14, 206/45.34, 68, 205, 418–420, 498, 521, 523–525, 527–528, 530, 532; 250/494, 506–507

[56] References Cited

UNITED STATES PATENTS

| | | | |
|---|---|---|---|
| 2,645,338 | 7/1953 | Scherer | 206/530 |
| 2,780,350 | 2/1957 | Simon et al. | 206/524 |
| 3,277,349 | 10/1966 | Hyland | 174/17.05 X |
| 3,432,666 | 3/1969 | Nash et al. | 250/506 |
| 3,531,644 | 9/1970 | Koster | 250/506 |
| 3,569,714 | 3/1971 | Anderson | 250/507 |
| 3,732,423 | 5/1973 | Peterson | 250/506 |
| 3,754,141 | 8/1973 | Leebl et al. | 250/507 |
| 3,769,490 | 10/1973 | Czaplinski | 250/506 X |

FOREIGN PATENTS OR APPLICATIONS

| | | | |
|---|---|---|---|
| 869,863 | 5/1971 | Canada | 206/523 |

*Primary Examiner*—Steven E. Lipman
*Attorney, Agent, or Firm*—Barnes, Kisselle, Raisch & Choate

[57] ABSTRACT

A package for fragile objects such as radioactive fusion pellets of micron size shipped in mounted condition or unmounted condition with a frangible inner container which is supported in a second inner container which in turn is supported in a final outer container, the second inner container having recesses for supporting alternate design inner containers.

4 Claims, 5 Drawing Figures

PACKAGE FOR FRAGILE OBJECTS

This invention relates to a Package for Fragile Objects and is directed to the provision of a means to ship radioactive objects and other fragile objects such as laser fusion pellets which are extremely small (micron size) spheres which may or may not contain radioactive material.

An object of the invention is to provide a packaging system which can be utilized for shipping very fragile mounted pellets to increase resistance to shock in the handling and also to provide a packaging unit which will receive containers having multiple pellets therein in unmounted condition.

It is a further object to provide a shipping container which can be reused and which provides a resistance to shock and vibration.

Another feature of the invention is an adjustable and variable fluid viscous damping which provides resistance against vibration and shock and also a package which permits the use of desirable containment fluid for surrounding radioactive objects.

Other objects and features of the invention will be apparent in the following description and claims in which the principles of the invention are set forth together with the best mode presently contemplated for the practice of the invention.

Figure 1:
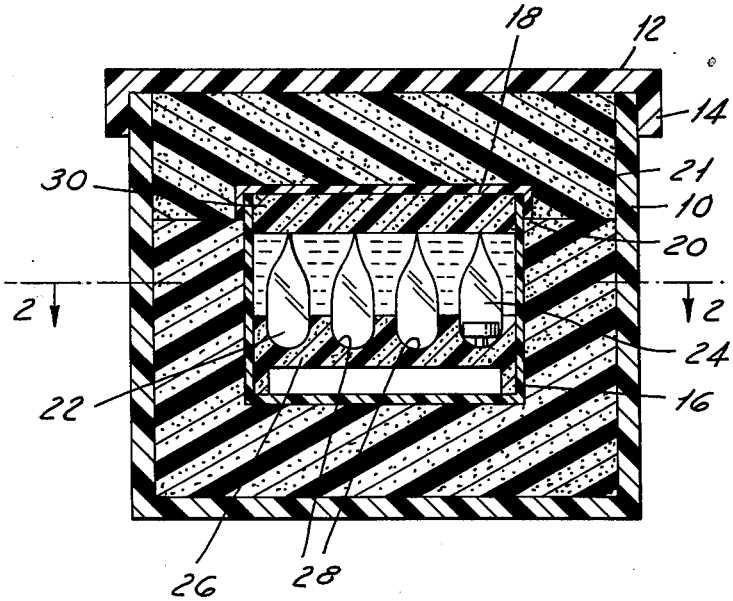

Drawings accompany the disclosure and the various views thereof may be briefly described as:

FIG. 1, a sectional view of the package in assembled condition.

Figure 2:
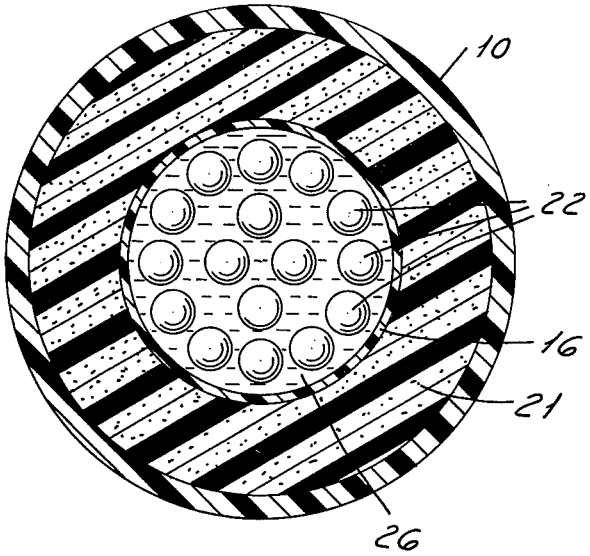

FIG. 2, a sectional view taken on line 2—2 of FIG. 1.

Figure 3:
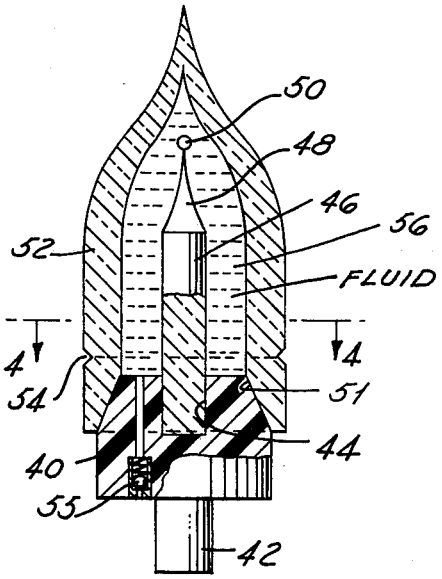

FIG. 3, a view of an inner container showing a mounting system.

Figure 4:
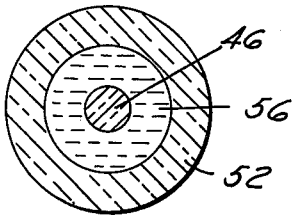

FIG. 4, a sectional view on line 4—4 of FIG. 3.

Figure 5:
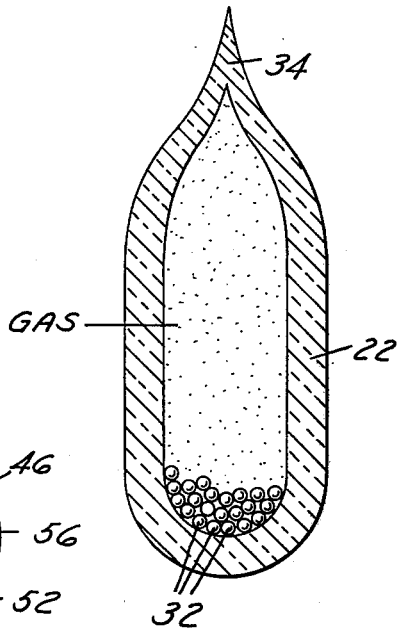

FIG. 5, a view of a modified inner container for holding multiple pellets.

With reference to the DRAWINGS, in FIG. 1 the assembly is shown having an outer container 10 provided with a slip-on or screw-on cover 12 with side flanges 14 to pass down over the walls of the cylindrical container 10. A second inner container 16 is similarly formed with a cover 18 having telescoping side flanges 20. Each of the containers 10 and 16 can be formed of a dense plastic material or, if desired, from a metal such as aluminum or magnesium. The container 16 is supported within container 10 by a shock absorbing material 21 such as low density polyurethane foam or the like.

The second inner container 16 contains what may be referred to as first inner containers 22 and 24, these being shown respectively in FIGS. 5 and 3. These first inner containers are held in place by a storage rack unit 26 which has a plurality of recesses 28 for receiving the bottom end of storage vials. A second element 30 at the top of the container 16 locates the storage vials against radial and axial shifting. The elements 26 and 30 can be formed of a material such as a foam plastic made from low density polyurethane, for example. The storage vials 22 are shown in FIG. 5 as a glass capsule which contains a plurality of pellets 32. These pellets may be small glass spheres formed in a dimension of 10 to 300 microns and thus they are very small and must be treated in such a way that they are not lost.

A suitable gas may be used in the space within the capsule 22 or the capsule may be filled with a solid or viscous damping fluid fill material to prevent the pellets from moving. The material from which the capsule or vial 22 is made may be glass or plastic and it can be sealed at the tip 34 after loading.

In FIG. 3, a modified inner container is shown wherein a plastic or metal base 40 has a mounting stem 42 and a recess 44 co-axial therewith. The mounting stem 42 may be used to mount the pellets in a suitably recessed base in a fusion reactor chamber. The recess is intended to receive a mounting stem 46 which has a very fine tip 48 on which is welded a pellet 50. In sealing relation at 51 with the base 40 is a glass or plastic vial or capsule 52 which has a gas tight sealing relationship with the base 40. A circumferential stress score 54 makes it easy to remove the top of the vial when it is desired to utilize the mounted pellet. Alternately, a check valve 55 in base 42 may be employed to introduce and/or remove fluids or gases contained by 52.

Within the sealed capsule is an isolation space 56 which can be filled with a gas or solid or fluid material to assist in the protection of the delicate mount. Filling material may be selected depending on the distance the package is intended to travel and the nature of the handling it will receive in transit. When it is desired to use the pellet 50 in a laser fusion system, for example, where the pellet is to be exposed to a laser beam, the frangible capsule 52 can be removed at the score line 54 and the post 42 can be used to mount the remaining assembly in a suitable fusion chamber.

The isolation chamber 56 shown in FIG. 3 can be filled with a suitable material depending on the particular pellet being shipped. For example, if the pellet contains Lih, LiD or LiDT, the space may be evacuated and a suitable solid or inert gas filled into the space to prevent or reduce chemical reaction. If liquid is utilized, this will reduce the shock and vibration loading tending to mechanically dislodge the mounted pellet during handling or shipping. In case of a solid filling, this might be removed by melting or chemically dissolving the solid material such as, for example, paraffin without damaging the mounted target.

It will be seen that the respective capsules shown in FIGS. 3 and 5 can each be inserted into the recesses of base 26 and retained in place by the top block 30. The space surrounding the capsule can be also filled with a shock reducing material such as a viscous liquid or a solid such as paraffin or other easily removed material. Inasmuch as shipping requirements for radioactive material necessitate double containment, the above-described package will suffice.

I claim:

1. A combination protective package for tiny pellets and the like which comprises:

a. a primary inner container having a base, b. an upright central shaft on said base having a slender tip, c. a pellet on said tip, d. a protective capsule sealed to said base enveloping said shaft and pellet in spaced relation thereto, and e. means to mount and position one or more of said capsules in spaced relation to each other and to the inner walls of a second container.

2. A shipping container for a pellet mounted for use in a laser fusion chamber which comprises a base, a stem rising from said base having a reduced tip on which a pellet is mounted, and a frangible bulb positioned over said stem having a base opening sealed to said base.

3. A shipping container as defined in claim 2 in which said base has a projection for mounting said base in a laser fusion chamber.

4. A shipping container as defined in claim 2 in which a passage is formed in said base leading to the interior of said bulb, and a check valve in said passage to limit the flow in said passage to one direction.

* * * * *